US010927852B2

(12) United States Patent
Joseph et al.

(10) Patent No.: US 10,927,852 B2
(45) Date of Patent: Feb. 23, 2021

(54) FLUID ENERGIZING DEVICE

(71) Applicant: SCHLUMBERGER TECHNOLOGY CORPORATION, Sugar Land, TX (US)

(72) Inventors: Jijo Oommen Joseph, Houston, TX (US); Jonathan Wun Shiung Chong, Sugar Land, TX (US); Garud Bindiganavale Sridhar, Sugar Land, TX (US); Alhad Phatak, Stafford, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 81 days.

(21) Appl. No.: 15/542,944

(22) PCT Filed: Jan. 11, 2016

(86) PCT No.: PCT/US2016/012789

§ 371 (c)(1),
(2) Date: Jul. 12, 2017

(87) PCT Pub. No.: WO2016/115003

PCT Pub. Date: Jul. 21, 2016

(65) Prior Publication Data

US 2018/0003196 A1 Jan. 4, 2018

Related U.S. Application Data

(60) Provisional application No. 62/102,474, filed on Jan. 12, 2015, provisional application No. 62/102,478, filed on Jan. 12, 2015.

(51) Int. Cl.
*F04F 1/20* (2006.01)
*E21B 43/26* (2006.01)
(Continued)

(52) U.S. Cl.
CPC ..... *F04F 1/20* (2013.01); *E21B 41/00* (2013.01); *E21B 43/26* (2013.01); *F04B 47/00* (2013.01);
(Continued)

(58) Field of Classification Search
CPC .. F04F 1/20; F04F 13/00; E21B 41/00; E21B 43/25; E21B 43/26; E21B 21/00; E21B 47/00
See application file for complete search history.

(56) References Cited

U.S. PATENT DOCUMENTS 3,431,747 A * 3/1969 Hashemi ..... B01D 61/06 417/339
3,560,053 A 2/1971 Ortloff
(Continued)

FOREIGN PATENT DOCUMENTS

WO 2000068566 A2 11/2000
WO 2008070210 A9 8/2008
WO 2012138367 A1 10/2012

OTHER PUBLICATIONS

International Search Report and Written Opinion issued in International Patent Application No. PCT/US2016/012789 dated Apr. 18, 2016; 21 pages.

*Primary Examiner* — Charles G Freay
(74) *Attorney, Agent, or Firm* — Rodney Warfford

(57) ABSTRACT

Apparatus and methods for energizing well operations fluids, including a fluid energizing device directly or operatively connected between first and second conduits. The fluid energizing device includes a chamber. A first fluid enters the chamber from the first conduit, and a second fluid enters the chamber from the second conduit and energizes the first fluid within the chamber. A third conduit conducts the energized first fluid from the chamber to a wellhead.

17 Claims, 6 Drawing Sheets

(51) Int. Cl.

| | |
|---|---|
| ***F04F 13/00*** | (2009.01) |
| ***F04B 47/00*** | (2006.01) |
| ***E21B 41/00*** | (2006.01) |
| *E21B 21/00* | (2006.01) |
| *E21B 43/25* | (2006.01) |

(52) U.S. Cl.
CPC ..... *F04F 13/00* (2013.01); *E21B 21/00* (2013.01); *E21B 43/25* (2013.01)

(56) References Cited

U.S. PATENT DOCUMENTS 4,199,680 A * 4/1980 Moon ..... C09K 8/62 166/250.17
4,352,638 A 10/1982 Vallance
4,354,805 A * 10/1982 Bauer ..... B01J 3/08 417/54
4,646,704 A 3/1987 Gora et al.
4,662,342 A 5/1987 Altmann et al.
4,706,621 A 11/1987 Okimoto et al.
4,796,595 A 1/1989 El-Nashar et al.
5,533,868 A * 7/1996 Fassbender ..... F04B 9/1176 417/103
5,899,272 A * 5/1999 Loree ..... C09K 8/80 166/280.2
6,449,939 B1 9/2002 Snyder
6,460,342 B1 10/2002 Nalim
7,845,413 B2 12/2010 Shampine et al.
7,938,627 B2 5/2011 Muller
9,739,128 B2 * 8/2017 Ghasripoor ..... E21B 43/26
9,945,216 B2 * 4/2018 Ghasripoor ..... E21B 43/16
2006/0037895 A1 2/2006 Shumway
2007/0104588 A1 * 5/2007 Bross ..... F04F 13/00 417/64
2007/0277982 A1 * 12/2007 Shampine ..... E21B 43/267 166/308.1
2009/0090503 A1 4/2009 Groves
2012/0217011 A1 8/2012 Dotson et al.
2013/0255953 A1 10/2013 Tudor
2013/0280038 A1 * 10/2013 Martin ..... F03B 13/00 415/110
2014/0048143 A1 * 2/2014 Lehner ..... F04F 13/00 137/14
2015/0184502 A1 * 7/2015 Krish ..... E21B 43/26 166/250.01
2016/0024909 A1 * 1/2016 Han ..... E21B 47/1015 166/250.1

* cited by examiner

FLUID ENERGIZING DEVICE

CROSS-REFERENCE TO RELATED APPLICATIONS

This application claims priority to and the benefit of U.S. Provisional Application No. 62/102,474, titled "A METHOD OF PUMPING OILFIELD FLUIDS FROM A WELL SURFACE TO A WELLBORE RESERVOIR UTILIZING A SHOCKWAVE," filed Jan. 12, 2015, the entire disclosure of which is hereby incorporated herein by reference.

This application also claims priority to and the benefit of U.S. Provisional Application No. 62/102,478, titled "METHODS OF ENERGIZING FLUIDS," filed Jan. 12, 2015, the entire disclosure of which is hereby incorporated herein by reference.

BACKGROUND OF THE DISCLOSURE

A variety of fluids are used in oil and gas operations. Fluids may be pumped into the subterranean formation through the use of one or more pumps. Abrasive fluids often containing insoluble particles in the fluid can reduce the life and increase maintenance of the pump.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an apparatus that includes a first conduit, a second conduit, and a fluid energizing device directly or operatively connected between the first and second conduits. The fluid energizing device includes a chamber. A first fluid enters the chamber from the first conduit, and a second fluid enters the chamber from the second conduit and energizes the first fluid within the chamber. The apparatus also includes a third conduit conducting the energized first fluid from the chamber to a wellhead.

The present disclosure also introduces a method that includes conducting a first fluid through a first conduit into a chamber of a fluid energizing device, energizing the first fluid within the chamber by conducting a second fluid through a second conduit into the chamber, and conducting the energized first fluid from the chamber to a wellhead.

The present disclosure also introduces a method that includes conducting a first fluid into a first one of multiple chambers of a fluid energizing device. The fluid energizing device includes a housing, a first end cap, and a second end cap. That housing includes the chambers. The first end cap includes a first inlet passage in fluid communication with the first one of the chambers, and a first outlet passage not in fluid communication with the first one of the chambers. The second end cap includes a second inlet passage and a second outlet passage, neither of which are in fluid communication with the first one of the chambers. The method also includes energizing the first fluid within the first one of the chambers by rotating the housing relative to the first and second end caps to establish fluid communication between the second inlet passage and the first one of the chambers while ceasing fluid communication between the first inlet passage and the first one of the chambers, and then conducting a second fluid into the first one of the chambers through the second inlet passage. The method also includes discharging the energized first fluid from the first one of the chambers by further rotating the housing relative to the first and second end caps to establish fluid communication between the first outlet passage and the first one of the chambers while ceasing fluid communication between the second inlet passage and the first one of the chambers. The energized first fluid discharged from the first one of the chambers is then conducted into a well.

These and additional aspects of the present disclosure are set forth in the description that follows, and/or may be learned by a person having ordinary skill in the art by reading the materials herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
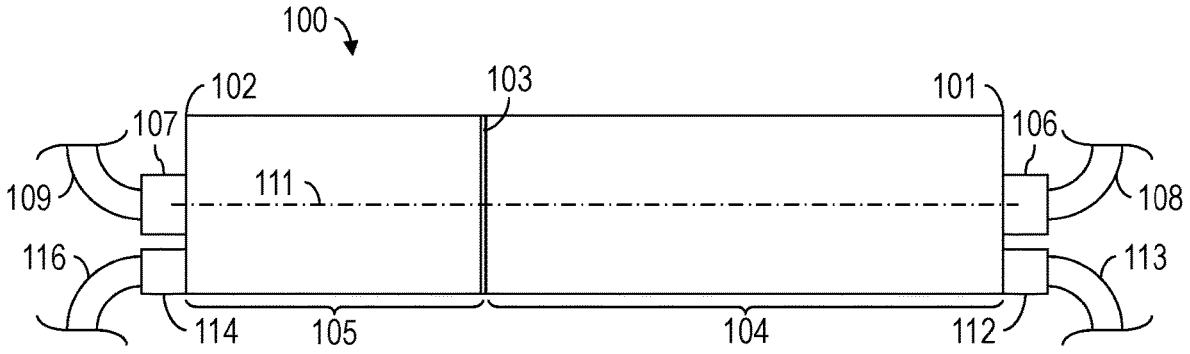
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. It should also be understood that the terms "first," "second," "third," etc., are arbitrarily assigned, are merely intended to differentiate between two or more parts, fluids, etc., and do not indicate a particular orientation or sequence.

As used herein, a "fluid" is a substance that can flow and conform to the outline of its container when the substance is tested at a temperature of 71° F. (22° C.) and a pressure of one atmosphere (atm) (0.1 megapascals (MPa)). A fluid can be liquid, gas, or both. A fluid can have just one phase or more than one distinct phase. A heterogeneous fluid is an example of a fluid having more than one distinct phase. Example heterogeneous fluids within the scope of the present disclosure include a slurry (such as may comprise a continuous liquid phase and undissolved solid particles as a dispersed phase), an emulsion (such as may comprise a continuous liquid phase and at least one dispersed phase of immiscible liquid droplets), a foam (such as may comprise a continuous liquid phase and a dispersed gas phase), and mist (such as may comprise a continuous gas phase and a dispersed liquid droplet phase), among other examples also within the scope of the present disclosure. A heterogeneous fluid may comprise more than one dispersed phase. Moreover, one or more of the phases of a heterogeneous fluid may comprise dissolved materials and/or undissolved solids.

Plunger pumps can be employed in high-pressure oilfield pumping applications, such as for hydraulic fracturing applications. Plunger pumps are often referred to as positive displacement pumps, intermittent duty pumps, triplex pumps, quintuplex pumps, or frac pumps. Multiple plunger pumps may be employed simultaneously in large-scale operations where tens of thousands of gallons of fluid are pumped into a wellbore. These pumps are linked to each other using a manifold, which is plumbed to collect the output of the multiple pumps and direct it to the wellbore.

Some fluids (e.g., fracturing fluid) may contain ingredients that are abrasive to the internal components of a pump. For example, a fracturing fluid generally contains proppant, which is insoluble in the base fluid. To create fractures, the fracturing fluid is generally pumped at high pressures, sometimes in the range of 5,000 to 15,000 pounds force per square inch (psi) or more. The proppant may initiate the fractures and/or keep the fractures propped open. The propped fractures provide highly permeably flow paths for oil and gas to flow from the subterranean formation, thereby enhancing the production of a well. However, the abrasive fracturing fluid may accelerate wear of the internal components of the pumps. Consequently, the repair, replacement, and maintenance expenses of the pumps can be quite high, and life expectancy can be low.

Example implementations of apparatus described herein relate generally to a fluid energizing device for energizing a first fluid with a second fluid, among other uses. The first fluid may be a "dirty" fluid that may be abrasive to pumps, and the second fluid may be a "clean" fluid that is not abrasive to the pumps. The fluid energizing device utilizes a chamber into which the first and second fluids are conducted. The second fluid may be conducted into the chamber at a higher pressure than the first fluid, and may thus be utilized to energize the first fluid. The energized first fluid is then conducted from the chamber to a wellhead. By pumping just a clean, second fluid through the pumps at a high pressure and permitting a pressure differential between the high pressure clean fluid and low pressure dirty fluid to increase the pressure of the dirty fluid, the useful life of the pumps can be increased. Example implementations of methods described herein relate generally to utilizing implementations of such fluid energizing device to energize the first fluid.

FIG. 1 is a schematic view of an example implementation of a chamber 100 of a fluid energizing device for energizing a first fluid with a second fluid according to one or more aspects of the present disclosure. The chamber 100 includes a first end 101 and a second end 102. The chamber 100 may include a membrane 103 defining a first volume 104 and a second volume 105 within the chamber 100. The membrane 103 may be impermeable or semi-permeable to a fluid, such as a gas. The membrane 103 may be an impermeable membrane in implementations in which the first and second fluids are incompatible fluids, or when mixing of the first and second fluids is undesirable, such as to recycle the clean second fluid absent contamination by the dirty first fluid. The membrane 103 may be a semi-permeable membrane in implementations permitting some mixing of the second fluid with the first fluid, such as to foam the first fluid when the second fluid comprises a gas. The membrane 103 may also not exist, such that the first and second volumes 104 and 105 form a continuous volume within the chamber 100. A first inlet valve 106 is operable to conduct the first fluid into the first volume 104 of the chamber 100, and a second inlet valve 107 is operable to conduct the second fluid into the second volume 105 of the chamber 100.

Figure 2:
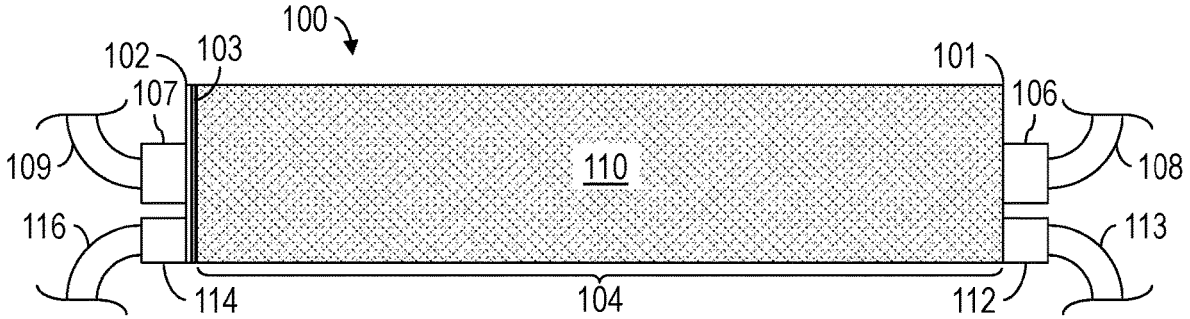
FIG. 2 is a schematic view of the apparatus shown in FIG. 1 in an operational stage according to one or more aspects of the present disclosure.

For example, FIG. 2 is a schematic view of the chamber 100 shown in FIG. 1 in an operational stage according to one or more aspects of the present disclosure, during which the first fluid 110 has been conducted into the chamber 100 through the first inlet valve 106 at the first end 101, such as via one or more fluid conduits 108. Consequently, the first fluid 110 may move the membrane 103 within the chamber 100 along a direction substantially parallel to the longitudinal axis 111 of the chamber 100, thereby increasing the first volume 104 and decreasing the second volume 105. The first inlet valve 106 may be closed after entry of the first fluid 110 into the chamber 100.

Figure 3:
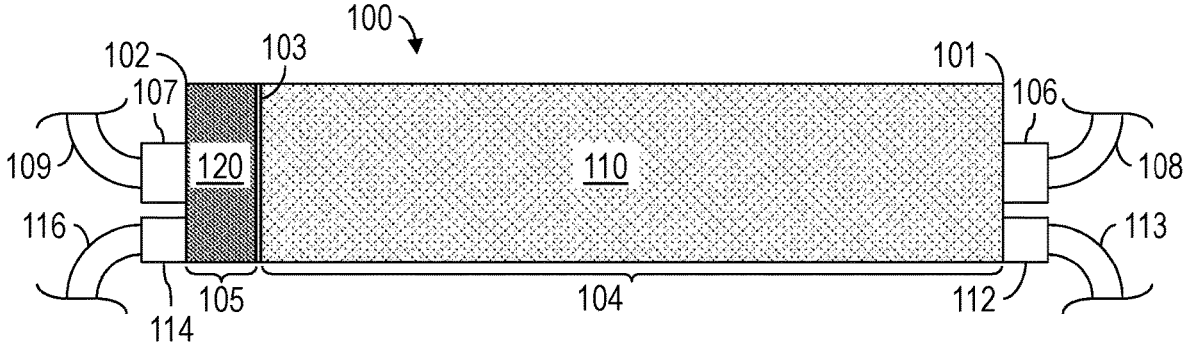
FIG. 3 is a schematic view of the apparatus shown in FIG. 2 in another operational stage according to one or more aspects of the present disclosure.
Figure 4:
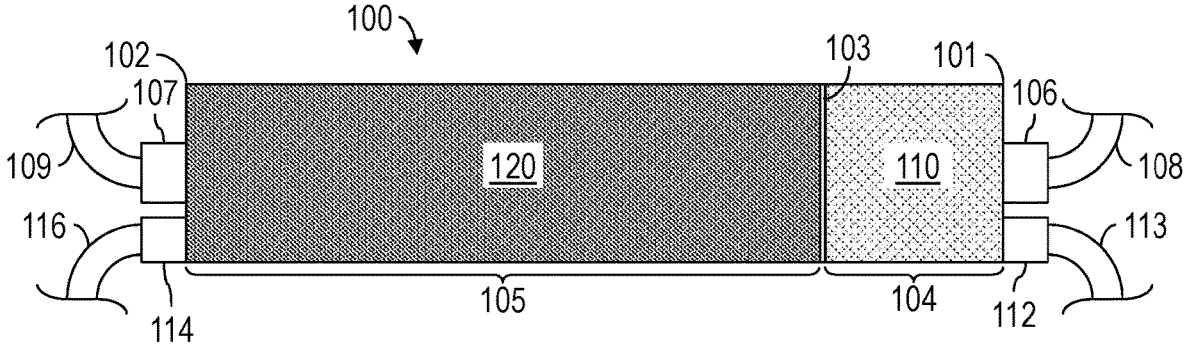
FIG. 4 is a schematic view of the apparatus shown in FIGS. 2 and 3 in another operational stage according to one or more aspects of the present disclosure.

FIG. 3 is a schematic view of the chamber 100 shown in FIG. 2 in a subsequent operational stage according to one or more aspects of the present disclosure, during which a second fluid 120 is being conducted into the chamber 100 through the second inlet valve 107 at the second end 102, such as via one or more fluid conduits 109. The second fluid 120 may be conducted into the chamber 100 at a higher pressure compared to the pressure of the first fluid 120. Consequently, the higher-pressure second fluid 120 may move the membrane 103 within the chamber 100 back towards the first end 101, thereby reducing the volume of the first volume 104 and thereby energizing the first fluid 110, as shown in FIG. 4. The second inlet valve 107 may then be closed, for example, in response to pressure sensed by a pressure transducer within the chamber 100 and/or along one or more of the conduits and/or inlet valves.

The membrane 103 and/or other components may include burst discs to protect against overpressure from the second fluid 120. The membrane 103 may continue to reduce the first volume 104 as the energized first fluid 110 is conducted from the chamber 100 to a wellhead (not shown) at a higher pressure than when the first fluid 110 entered the chamber 100, such as via a first exit valve 112 and one or more conduits 113. The second fluid 120 may be a combustible or cryogenic gas that, upon combustion or heating, acts to energize the first fluid 110, whether instead of or in addition to the higher pressure of the second fluid 120 acting to energize the first fluid 110. The second fluid 120 may also act to energize the first fluid 110 via generation of a shockwave, as described below. After the energized first fluid 110 is discharged from the chamber 100, the second fluid 120 may be drained via an exit valve 114 at the second end 102 of the chamber 100 and one or more conduits 116. The discharged second fluid 120 may be stored as waste fluid or reused during subsequent iterations of the fluid energizing process. For example, additional quantities of the first and second fluids 110 and 120 may then be introduced into the chamber 100 to repeat the energizing process to achieve a substantially continuous supply of energized first fluid 110.

Figure 5:
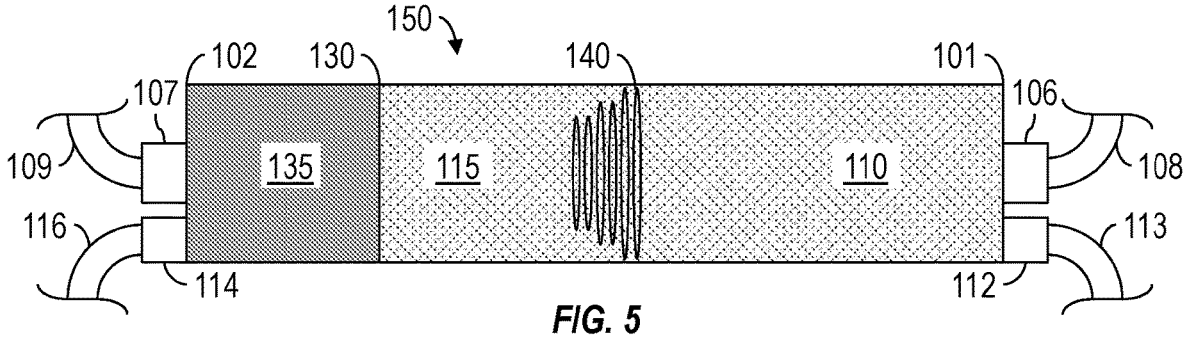
FIG. 5 is a schematic view of at least a portion of another example implementation of the apparatus shown in FIGS. 1-4 according to one or more aspects of the present disclosure.

FIG. 5 is a schematic view of another example implementation of the fluid energizing device chamber 100 shown in FIGS. 1-4, designated in FIG. 5 by reference number 150. The chamber 150 shown in FIG. 5 does not include the membrane 103, but may otherwise be the same or substantially similar to the chamber 100 shown in FIGS. 1-4. As with the fluid-energizing operation utilized with the chamber 100 shown in FIGS. 1-4, the second fluid 120 is conducted into the chamber 150 at a far higher pressure than the first fluid 110, thereby energizing the first fluid 110.

For example, the interaction of the low-pressure first fluid 110 and the high-pressure second fluid 120 creates a shockwave 140. The shockwave 140 is generated due to the abrupt pressure difference between the first and second fluids 110 and 120, similar to the phenomena of a "water hammer" inside the chamber 150. The shockwave 140 propagates within the chamber 150 in a direction extending from the second end 102 to the first end 101 (left to right in FIG. 5). The shockwave 140 propagates through the first fluid 110 at a supersonic velocity. A mixing front 130, or the interaction of the first and second fluids 110 and 120, moves in the same direction as the shockwave 140, but following the shockwave 140 at a subsonic velocity. The portion 115 of the first fluid 110 located between the shockwave 140 and the mixing front 130 is energized to high pressure, such as to between about 5,000 psi and about 15,000 psi. The first and second fluids 110 and 120 behind the mixing front 130 form a fluid mixture 135, which travels in the same direction as the shockwave 140 at subsonic velocity and at an intermediate pressure between the initial pressures of the first and second fluids 110 and 120.

When the shockwave 140 has traversed the length of the chamber 150 and reached the first end 101, the mixing front 130 is still lagging due to its lower velocity. However, after the shockwave 140 has reached the first end 101, the high-pressure first fluid 115 can be discharged from the chamber 150 by opening the exit valve 112 at the first end 101 of the chamber 150, thus permitting the high-pressure first fluid 115 to be directed to the wellbore (not shown) via one or more conduits 113. A portion of the fluid mixture 135 may also be discharged with the high-pressure first fluid 115.

Figure 7:
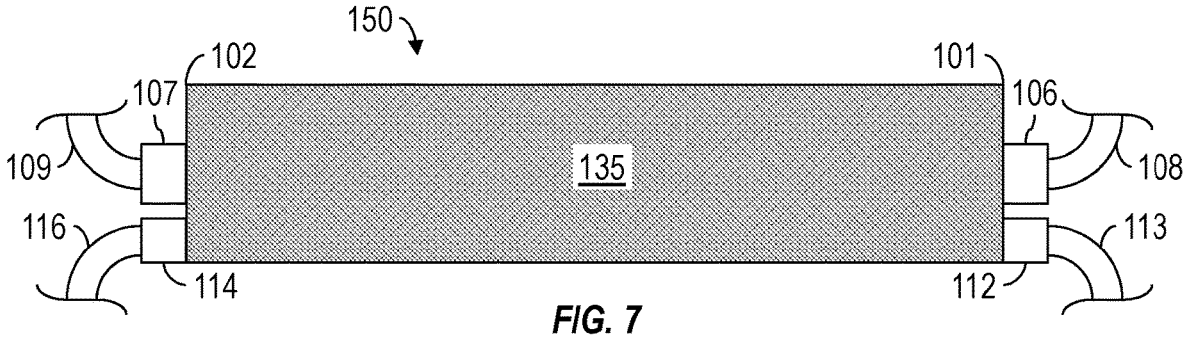
FIG. 7 is a schematic view of the apparatus shown in FIGS. 5 and 6 in another operational stage according to one or more aspects of the present disclosure.

As shown in FIG. 7, the pressure in the chamber 150 will eventually equalize with the wellbore pressure, such that fluid will no longer pass to the wellbore. At this point (or before), the exit valve 112 is closed. The fluid mixture 135 remaining in the chamber 150 (at the intermediate pressure) can then be drained via the exit valve 114 at the second end 102 of the chamber 150 and one or more conduits 116. The discharged fluid mixture 135 may be stored as waste fluid or reused as at least a portion of the second fluid 120 utilized in subsequent iterations of the energizing process. Additional quantities of the first and second fluids 110 and 120 can then be introduced into the chamber 150 to repeat the energizing process to achieve a substantially continuous supply of energized first fluid 115.

To produce the shockwave 140, the input pressure of the second fluid 120 may be about 1000% greater than the input pressure of the first fluid 110, although larger pressure differentials are also within the scope of the present disclosure. Pressure differentials less than about 1000% may also produce a shockwave depending on the geometry of the chamber 150, the operation of the fluid energizing device comprising the chamber 150, and/or the viscosity, density, and/or other properties of the first and second fluids 110 and 120, among other factors.

Implementations of a fluid energizing device that utilize a shockwave 140 to energize the first fluid 110 may be useful in fracturing operations where the fluid entering the wellbore is at a pressure greater than the fracture pressure of the subterranean formation. However, other operations may also benefit from shockwave-energizing implementations within the scope of the present disclosure. Fluid energizing devices comprising the chamber 100 shown in FIGS. 1-4 may also be utilized to energize the first fluid 110 utilizing a shockwave as described above, even with the inclusion of the membrane 103.

When no shockwave is produced within the chamber, the second fluid 120 can still energize the first fluid 110, whether due simply to the pressure differential or via combustion, heating, and/or other ways. A lack of shockwave may be useful in drilling, workover, cementing, and/or other operations in which the fluid entering the wellbore is generally at a pressure less than the fracture pressure of the subterranean formation.

Figure 6:
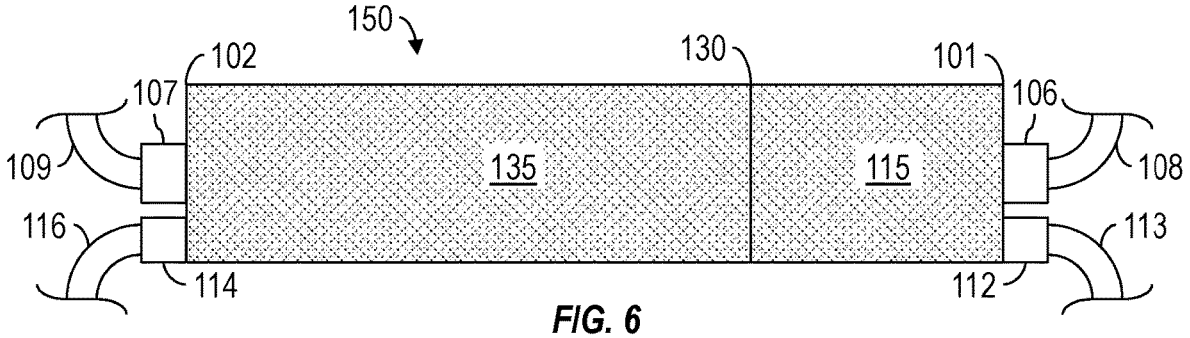
FIG. 6 is a schematic view of the apparatus shown in FIG. 5 in another operational stage according to one or more aspects of the present disclosure.

A fluid energizing device comprising the apparatus shown in FIGS. 1-4, the apparatus shown in FIGS. 5-7, and/or others within the scope of the present disclosure may also comprise more than one of the example chambers 100/150 described above. For example, FIG. 8 is a schematic view of an example fluid energizing device 200 containing multiple chambers 150 circumferentially spaced about a perimeter of a housing 201 according to one or more aspects of the present disclosure.

The housing 201 is disposed between opposing end caps 202 and 203 in a manner permitting relative rotation between the housing 201 and the end caps 202 and 203. For example, the end caps 202 and 203 may be positionally set, and the housing 201 may rotate around its longitudinal axis 210, relative to the end caps 202 and 203, or the end caps 202 and 203 may rotate around the longitudinal axis 210 relative to the housing 201. Such rotation may be via a motor (not shown) operably connected to the housing 201 or one or both end caps 202 and 203. Rotation may also be achieved by a rotor within one or more of the chambers 150 and/or other portions of the housing 201, or by disposing the chambers 150 helically within the housing 201, such that rotation of the housing 201 is induced by fluid flow through the chambers 150. In FIG. 8, the housing 201 is depicted as rotating about longitudinal axis 210 by arrow 220.

The end caps 202 and 203 may functionally replace the valves 106, 107, 112, and 114 depicted in FIGS. 1-7. For example, the first end cap 202 may be substantially disc-shaped, or may comprise a substantially disc-shaped portion, through which an inlet passage 204 and an exit passage 205 extend. The inlet passage 204 may act as the first inlet valve 106 shown in FIGS. 1-7, and the exit passage 205 may act as the first exit valve 112 shown in FIGS. 1-7. Similarly, the second end cap 203 may be substantially disc-shaped, or may comprise a substantially disc-shaped portion, through which an inlet passage 206 and an exit passage 207 extend. The inlet passage 206 may act as the second inlet valve 107 shown in FIGS. 1-7, and the exit passage 207 may act as the second exit valve 114 shown in FIGS. 1-7. The passages 204-207 may have a variety of dimensions and shapes. For example, as in the example implementation depicted in FIG. 8, the passages 204-207 may each have dimensions and shapes substantially corresponding to the cross-sectional dimensions and shapes of the openings of each chamber 150 at the opposing ends of the housing 201. However, other implementations are also within the scope of the present disclosure, provided that the chambers 150 may each be sealed against the end caps 202 and 203 in a manner preventing fluid leaks. For example the surfaces of the end caps 202 and 203 that mate with the corresponding ends of the housing 201 may comprise face seals and/or other sealing means. Particles in the first and/or second fluids may also be utilized to aid in sealing between the relatively rotating portions of the housing 201 and the end caps 202 and 203.

Figure 8:
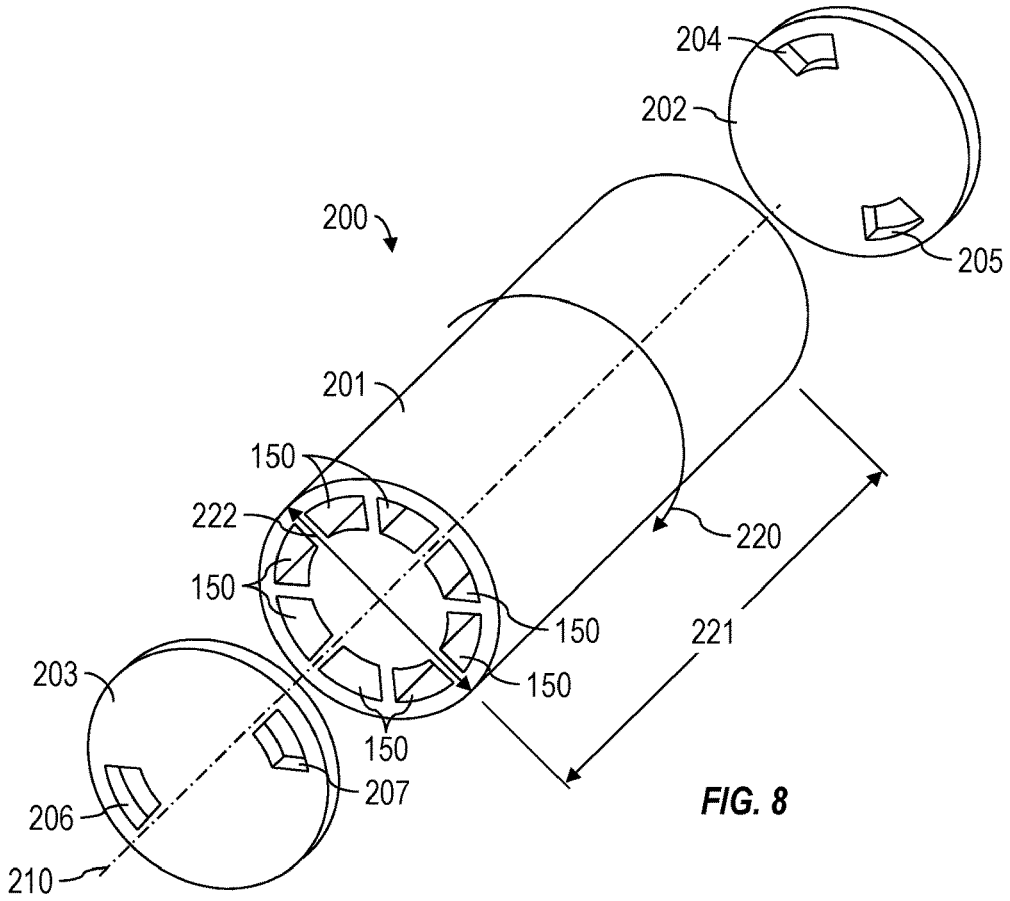
FIG. 8 is a schematic view of at least a portion of an example implementation of apparatus according to one or more aspects of the present disclosure.

In the example implementation depicted in FIG. 8, the housing 201 comprises eight chambers 150. However, other implementations within the scope of the present disclosure may comprises as few as two chambers 150, or as many as several dozen. The rotational speed may also vary and may be timed as per the velocity of the shockwave or pressure differential between the first and second fluids and the length 221 of the chambers 150 so that the timing of the valves 204-207 are adjusted in order to facilitate proper functioning as described herein. The rotational speed may be based on the intended flow rate of the energized first fluid exiting the chambers 150 collectively, the amount of pressure differential between the first and second fluids, and/or the dimensions of the chambers 150. For example, larger dimensions of the chambers 150 and greater rotational speed of the housing 201 relative to the end caps 202 and 203 will increase the discharge volume of the energized first fluid.

The size and number of instances of the fluid energizing device 200 utilized at a wellsite in oil and gas operations may depend on the location of the fluid energizing device 200 within the process flow stream at the wellsite. For example, some oil and gas operations at a wellsite may utilize multiple pumps (such as the pumps 306 shown in FIG. 11) that each receive low-pressure dirty fluid from a common manifold (such as the manifold 308 shown in FIG. 11) and then pressurize the dirty fluid for return to the manifold. For such operations, an instance of the fluid energizing device 200 may be utilized between each pump and the manifold, one or more instances of the fluid energizing device 200 may replace one or more of the pumps. In such implementations, the housing 201 may have a length 221 ranging between about 25 centimeters (cm) and about 150 cm, and a diameter 222 ranging between about 10 cm and about 30 cm, the cross-sectional area (flow area) of each chamber 150 may range between about 5 $cm^2$ and about 20 $cm^2$, and/or the volume of each chamber 150 may range between about 75 cubic cm (cc) and about 2500 cc, although other dimensions are also within the scope of the present disclosure.

In other implementations, the pumps may each receive low-pressure clean fluid from the manifold (such as may be received at the manifold from a secondary fluid source) and then pressurize the clean fluid for return to the manifold. The pressurized clean fluid may then be conducted from the manifold to one or more instances of the fluid energizing device 200 to be utilized to energize low-pressure dirty fluid received from a gel maker, proppant blender, and/or other low-pressure processing device, and the energized dirty fluid discharged from the fluid energizing device(s) 200 may be conducted towards a well. Examples of such operations include those shown in FIGS. 12-15, among other examples within the scope of the present disclosure. In such implementations, the length 221 of the housing 201, the diameter 222 of the housing 201, the flow area of each chamber 150, the volume of each chamber 150, and/or the number of chambers 150 may be much larger than as described above.

Figure 9:
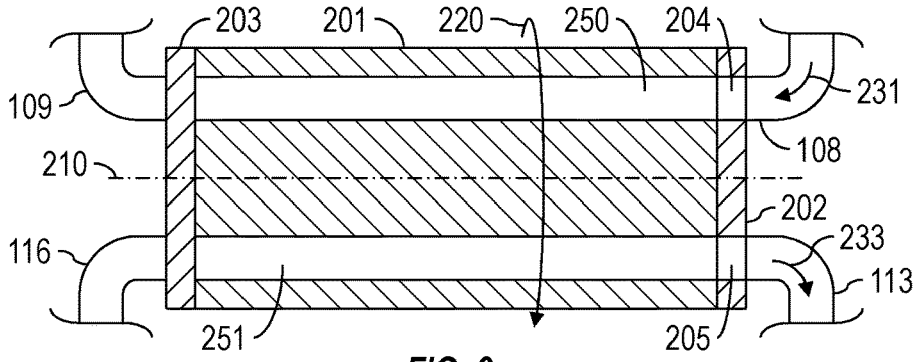
FIG. 9 is a sectional view of the apparatus shown in FIG. 8.

FIG. 9 is a cross-sectional view of the apparatus shown in FIG. 8 during an operational stage in which two of the chambers are substantially aligned with the passages 204 and 205 of the first end cap 202 but not with the passages 206 and 207 of the second end cap 203. Thus, the inlet passage 204 fluidly connects one of the depicted chambers 150, designated by reference number 250 in FIG. 9, with the one or more conduits 108 supplying the non-energized first fluid, such that the non-energized first fluid may be conducted into the chamber 250. At the same time, the exit passage 205 fluidly connects another of the depicted chambers 150, designated by reference number 251 in FIG. 9, with the one or more conduits 113 conducting previously energized first fluid out of the chamber 251, such as for conduction into a wellbore (not shown). As the housing 201 rotates relative to the end caps 202 and 203, the chambers 250 and 251 will rotate out of alignment with the passages 204 and 205, thus preventing fluid communication between the chambers 250 and 251 and the respective conduits 108 and 113.

Figure 10:
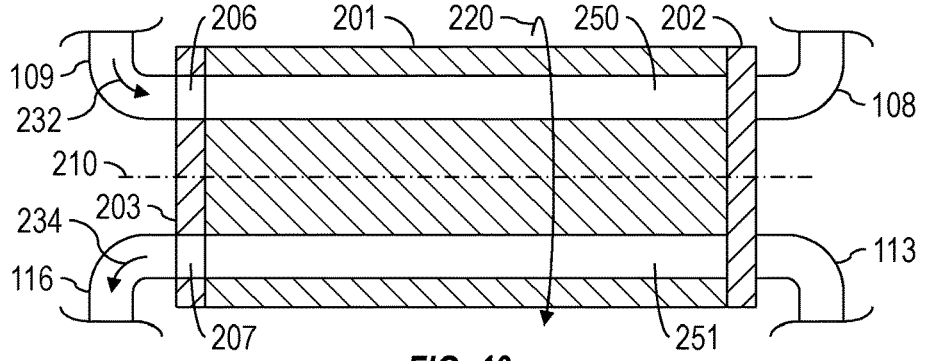
FIG. 10 is another view of the apparatus shown in FIG. 9 in a different stage of operation.

FIG. 10 is another view of the apparatus shown in FIG. 9 during another operational stage in which the chambers 250 and 251 are substantially aligned with the passages 206 and 207 of the second end cap 203 but not with the passages 204 and 205 of the first end cap 202. Thus, the inlet passage 206 fluidly connects the chamber 250 with the one or more conduits 109 supplying the energizing second fluid, such that the second fluid may be conducted into the chamber 250. At the same time, the exit passage 207 fluidly connects the other chamber 251 with the one or more conduits 116 conducting previously used energizing second fluid out of the chamber 251, such as for recirculation to the second fluid source (not shown). As the housing 201 further rotates relative to the end caps 202 and 203, the chambers 250 and 251 will rotate out of alignment with the passages 206 and 207, thus preventing fluid communication between the chambers 250 and 251 and the respective conduits 109 and 116.

The energizing process described above with respect to FIGS. 1-7 is achieved within each chamber 150/250/251 with each full rotation of the housing 201 relative to the end caps 202 and 203. For example, as the housing 201 rotates relative to the end caps 202 and 203, the non-energized first fluid is conducted into the chamber 250 during the portion of the rotation in which the chamber 250 is in fluid communication with inlet passage 204 of the first end cap 202, as indicated in FIG. 9 by arrow 231. The rotation is continuous, such that the flow rate of non-energized first fluid into the chamber 250 increases as the chamber 250 comes into alignment with the inlet passage 204 and then decreases as the chamber 250 rotates out of alignment with the inlet passage 204. Further rotation of the housing 201 relative to the end caps 202 and 203 permits the energizing second fluid to be conducted into the chamber 250 during the portion of the rotation in which the chamber 250 is in fluid communication with the inlet passage 206 of the second end cap 203, as indicated in FIG. 10 by arrow 232. The influx of the energizing second fluid into the chamber 250 energizes the first fluid, such as due to the pressure differential between the first and second fluids and perhaps the shockwave mechanism described above with respect to FIGS. 5-7. Further rotation of the housing 201 relative to the end caps 202 and 203 permits the energized first fluid to be conducted out of the chamber 250 during the portion of the rotation in which the chamber 250 is in fluid communication with the exit passage 205 of the first end cap 202, as indicated in FIG. 9 by arrow 233. The discharged fluid may substantially comprise just the (energized) first fluid or a mixture of the first and second fluids (also energized), depending on the timing of the housing 201 and perhaps whether the chambers include the membrane 103 shown in FIGS. 1-4. Further rotation of the housing 201 relative to the end caps 202 and 203 permits the reduced-pressure second fluid to be conducted out of the chamber 250 during the portion of the rotation in which the chamber 250 is in fluid communication with the exit passage 207 of the second end cap 203, as indicated in FIG. 10 by arrow 234. The energizing process then repeats as the housing 201 further rotates and the chamber 250 again comes into alignment with the inlet passage 204 of the first end cap 202.

Depending on the number and size of the chambers 150, the non-energized first fluid inlet passage 204 and the energizing second fluid inlet passage 206 may be wholly or partially misaligned with each other about the central axis 210, such that the first fluid may be conducted into a chamber 150 to entirely or mostly fill the chamber 150 before the second fluid is conducted into that chamber 150. The non-energized first fluid inlet passage 204 is completely closed to fluid flow from the conduit 108 before the energizing second fluid inlet passage 206 begins opening. Complete closure of the non-energized first fluid inlet passage 204 may permit a shockwave to be produced when the second fluid is introduced, as described above. The energized first fluid exit passage 205 and the reduced-pressure second fluid exit passage 207, however, may be partially open when the energizing second fluid inlet passage 206 is permitting the second fluid into the chamber 150. Similarly, the non-energized first fluid inlet passage 204 may be partially open when one or both of the energized first fluid exit passage 205 and/or the reduced-pressure second fluid exit passage 207 is at least partially open.

The energized first fluid exit passage 205 and the reduced-pressure second fluid exit passage 207 may be wholly or partially misaligned with each other about the central axis 210. For example, the energized first fluid (and perhaps an energized mixture of the first and second fluids) may be substantially discharged from a chamber 150 via the energized first fluid exit passage 205 before the remaining reduced-pressure second fluid is permitted to exit through the reduced-pressure second fluid exit passage 207. As the housing 201 continues to rotate relative to the end caps 202 and 203, the energized first fluid exit passage 205 becomes closed to fluid flow, and the reduced-pressure second fluid exit passage 207 becomes open to discharge the remaining reduced-pressure second fluid. Thus, the reduced-pressure second fluid exit passage 207 may be completely closed to fluid flow while the energized first fluid (or mixture of the first and second fluids) is discharged from the chamber 150 to the wellhead. Complete closure of the reduced-pressure second fluid exit passage 207 may permit the energized fluid to maintain a higher-pressure flow to the wellhead.

The inlet and exit passages 204-207 may also be configured to permit fluid flow into and out of more than one chamber 150 at a time. For example, the non-energized first fluid inlet passage 204 may be sized to simultaneously fill more than one chamber 150, the inlet and exit passages 204-207 may be configured to permit non-energized first fluid to be conducted into a chamber 150 while the reduced-pressure second fluid is simultaneously being discharged from that chamber 150. Depending on the size of the housing 201 and the chambers 150, the fluid properties of the first and second fluids, and the rotational speed of the housing 201 relative to the end caps 202 and 203, the energizing process within each chamber 150 may also be achieved in less than one rotation of the housing 201 relative to the end caps 202 and 203, such as in implementations in which two, three, or more iterations of the energizing process is achieved within each chamber 150 during a single rotation of the housing 201.

The fluid energizing devices shown in FIGS. 1-10 and/or otherwise within the scope of the present disclosure may utilize various forms of the first and second fluids 110 and 120, respectively, in which the first fluid 110 may be a "dirty" fluid and the second fluid 120 may be a "clean" fluid. For example, the first fluid 110 may be a high-density and/or high-viscosity fluid comprising insoluble particles and/or other ingredients that may compromise the life or maintenance of pumps disposed downstream of the fluid energizing device, especially when such pumps are operated at higher pressures. Examples of the first fluid 110 utilized in oil and gas operations include treatment fluid, drilling fluid, spacer fluid, workover fluid, a cement composition, fracturing fluid, acidizing fluid, stimulation fluid, and/or combinations thereof, among others within the scope of the present disclosure. The first fluid 110 may be a foam, slurry, emulsion, or a compressible gas.

The composition of the second fluid 120 permits the second fluid to be pumped at higher pressures with little to no adverse effects on the downstream pumps. For example, the second fluid 120 may not include insoluble particles, or may include low concentrations of abrasive ingredients. The second fluid 120 may be a liquid, such as water (including freshwater, brackish water, or brine), a gas (including a cryogenic gas), or combinations thereof. The second fluid 120 may also include substances, such as tracers, that can be transferred to the first fluid 110 upon mixing within the chamber 100 or upon transmission through a semi-permeable implementation of the membrane 103.

The following are examples of the first and second fluids 110 and 120 that may be utilized for example oil and gas operations. However, the following are merely examples, and are not considered to be limiting to the first and second fluids 110 and 120 that can also be utilized within the scope of the present disclosure.

For fracturing operations, the first fluid 110 may be a slurry with a continuous phase comprising water and a dispersed phase comprising proppant (including foamed slurries), including implementations in which the dispersed proppant includes two or more different size ranges and/or shapes, such as may optimize the amount of packing volume within the fractures. The first fluid 110 may also be a cement composition (including foamed cements), or a compressible gas. For such fracturing implementations, the second fluid 120 may be a liquid comprising water, a foam comprising water and gas, a gas, a mist, or a cryogenic gas.

For cementing operations, including squeeze cementing, the first fluid 110 may be a cement composition comprising water as a continuous phase and cement as a dispersed phase, or a foamed cement composition. For such cementing implementations, the second fluid 120 may be a liquid comprising water, a foam comprising water and gas, a gas, a mist, or a cryogenic gas.

For drilling, workover, acidizing, and other wellbore operations, the first fluid 110 may be a homogenous solution comprising water, soluble salts, and other soluble additives, a slurry with a continuous phase comprising water and a dispersed phase comprising additives that are insoluble in the continuous phase, an emulsion or invert emulsion comprising water and a hydrocarbon liquid, or a foam of one or more of these examples. In such implementations, the second fluid 120 may be a liquid comprising water, a foam comprising water and gas, a gas, a mist, or a cryogenic gas.

In the above example implementations, and/or others within the scope of the present disclosure, the first fluid 120 may include proppant; swellable or non-swellable fibers; a curable resin; a tackifying agent; a lost-circulation material; a suspending agent; a viscosifier; a filtration control agent; a shale stabilizer; a weighting agent; a pH buffer; an emulsifier; an emulsifier activator; a dispersion aid; a corrosion inhibitor; an emulsion thinner; an emulsion thickener; a gelling agent; a surfactant; a foaming agent; a gas; a breaker; a biocide; a chelating agent; a scale inhibitor; a gas hydrate inhibitor; a mutual solvent; an oxidizer; a reducer; a friction reducer; a clay stabilizing agent; an oxygen scavenger; cement; a strength retrogression inhibitor; a fluid loss additive; a cement set retarder; a cement set accelerator; a light-weight additive; a de-foaming agent; an elastomer; a mechanical property enhancing additive; a gas migration control additive; a thixotropic additive; and/or combinations thereof.

Figure 11:
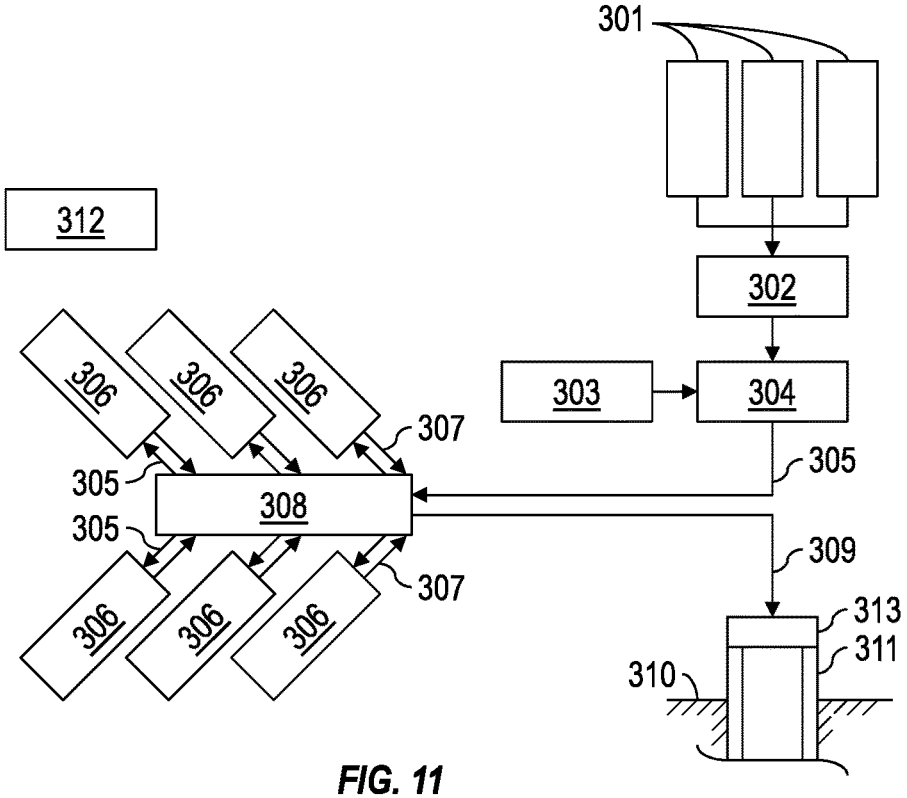
FIG. 11 is a schematic view of at least a portion of an example implementation of apparatus according to one or more aspects of the present disclosure.

FIG. 11 is a schematic view of an example wellsite layout that may be utilized for pumping a treatment fluid from a wellsite surface 310 to a well 311 (such as to a wellhead 313) during an oil and gas operation. A clean fluid, such as water, from a plurality of water tanks 301 may be pumped to a gel maker 302. The gel maker 302 mixes the water with a gelling agent to form a gel. The clean fluid or the gelled fluid may be mixed with various ingredients, such as proppant and/or other additives from a supply/feeder 303, in a blending apparatus 304, thus forming a treatment fluid. The treatment fluid is pumped from the blending apparatus 304 to a plurality of plunger, frac, and/or other pumps 306 through a system of conduits 305 and a manifold 308. Each pump 306 pressurizes the treatment fluid, which is then returned to the manifold 308 through another system of conduits 307. The treatment fluid is then directed to the well 311 (via wellhead 313) through one or more conduits 309. A control unit 312 may be operable to control various portions of such processing via wired and/or wireless communications (not shown).

The wellsite layout of FIG. 11 may be modified to incorporate a fluid energizing device according to one or more aspects of the present disclosure, as depicted in the example implementations shown in FIGS. 12-16. The example implementations depicted in FIGS. 12-16 eliminate pumping of a dirty fluid containing insoluble particles or high concentrations of abrasive ingredients through the pumps 306. The following description refers to FIGS. 1-12, collectively.

The first fluid 110 can be conducted from the blending apparatus 304 to one or more chambers 100/150/250/251 of a fluid energizing device 320 via the conduit system 305. The fluid energizing device 320 may be, comprise, and/or otherwise have one or more aspects in common with the apparatus shown in one or more of FIGS. 1-10. Thus, as similarly described above with respect to FIGS. 1-10, the fluid energizing device 320 comprises a non-energized first fluid inlet 331, a pressurized second fluid inlet 332, an energized fluid discharge 333, and a reduced-pressure fluid discharge 334. By utilizing the fluid energizing device 320, the "dirty" first fluid 110 is not conducted through the pumps 306. Consequently, the pumps 306 may conduct the clean second fluid 120 to and from the manifold 308.

A centrifugal or other type of pump 314 may supply the clean second fluid 120 to the manifold 308 from a holding or frac tank 322 through a conduit system 315. An additional source of fluid to be pressurized by the manifold 308 may be flowback fluid from the well 311. The pressurized second fluid 120 is conducted from the manifold 308 to one or more chambers of the fluid energizing device 320 via a conduit system 316. The energized fluid discharged from the fluid energizing device 320 is then conducted to the wellhead 313 of the well 311 via a conduit system 309. The reduced-pressure second fluid 120 (or mixture) remaining in the fluid energizing device 320 (or chamber 100/150 thereof) may then be conducted to a settling tank/pit 318 via a conduit system 317, where the fluid may be recycled back into the high-pressure stream via a centrifugal or other type of pump 321 and the conduit system 319, such as to the tank 322.

Some of the components, such as conduits, valves, and the manifold 308, may be configured to provide dampening to accommodate pressure pulsations. For example, liners that expand and contract may be employed to prevent problems associated with pumping against a closed valve due to intermittent pumping of the high-pressure fluid stream.

Figure 12:
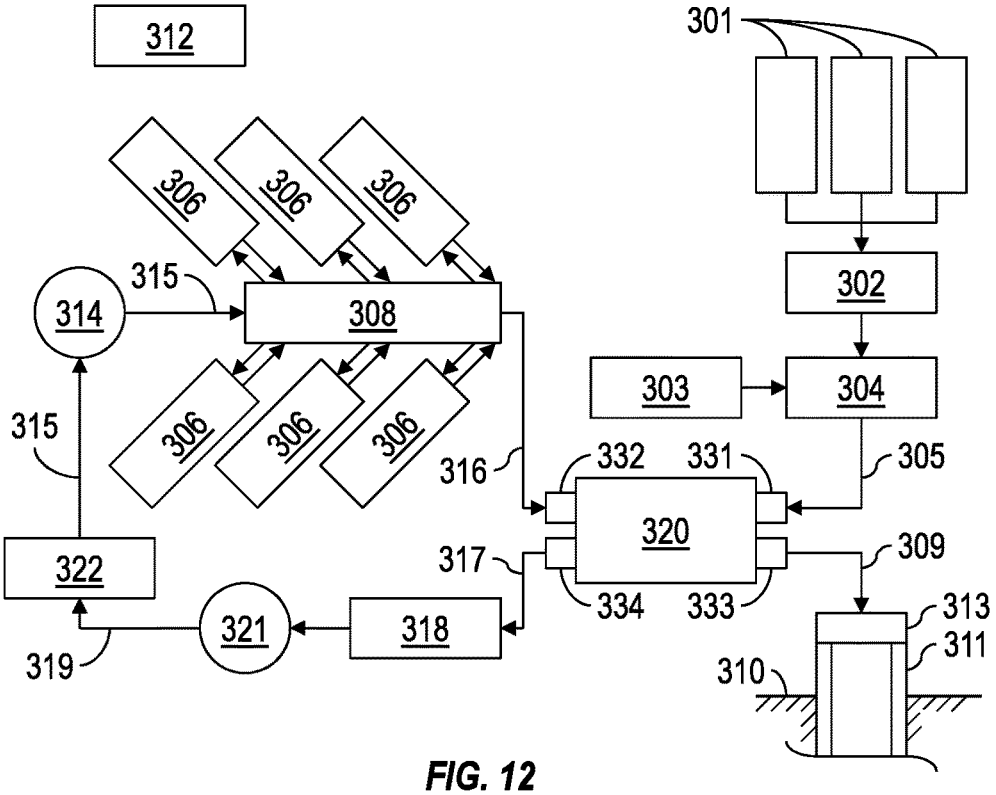
FIG. 12 is a schematic view of at least a portion of an example implementation of apparatus according to one or more aspects of the present disclosure.
Figure 13:
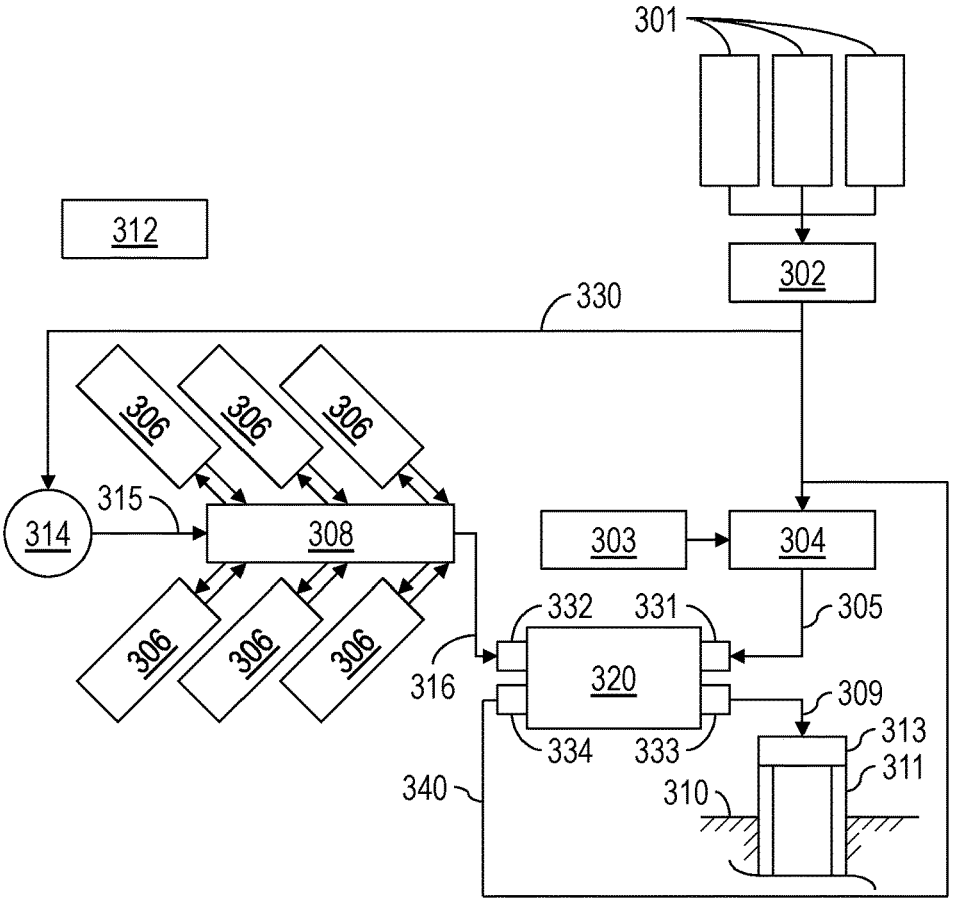
FIG. 13 is a schematic view of at least a portion of an example implementation of apparatus according to one or more aspects of the present disclosure.

FIG. 13 is a schematic view of another example implementation of the system shown in FIG. 12, in which the clean first fluid is conducted to the manifold 308 via a conduit system 330 via the pump 314 and the conduit system 315. That is, the fluid stream leaving the gel maker 302 may be split into the low-pressure side, for utilization by the blending apparatus 304, and the high-pressure side, for pressurization by the manifold 308. Similarly, although not depicted in FIG. 13, the fluid stream entering the gel maker 302 may be split into the low-pressure side, for utilization by the gel maker 302, and the high-pressure side, for pressurization by the manifold 308. Thus, the "clean" stream and the "dirty" stream may have the same source, instead of utilizing the tank 322 or other separate clean fluid source.

FIG. 13 also depicts the option for the reduced-pressure fluid discharged from the fluid energizing device 320 to be recycled back into the low-pressure flow stream between the gel maker 302 and the blending apparatus 304 via a conduit system 340. In such implementations, the feeder 303 may regulate the concentration of proppant and/or other ingredients into the blending apparatus 304 based on the concentration of proppant and/or ingredients entering the low-pressure stream from the conduit system 340. The feeder 303 may be adjusted to decrease the concentration of proppant and/or other ingredients based on the concentrations in the fluid being recycled into the low-pressure stream. Similarly, although not depicted in FIG. 13, the reduced-pressure fluid discharged from the fluid energizing device 320 may be recycled back into the low-pressure flow stream before the gel maker 302, or perhaps into the low-pressure flow stream between the blending apparatus 304 and the fluid energizing device 320.

Figure 14:
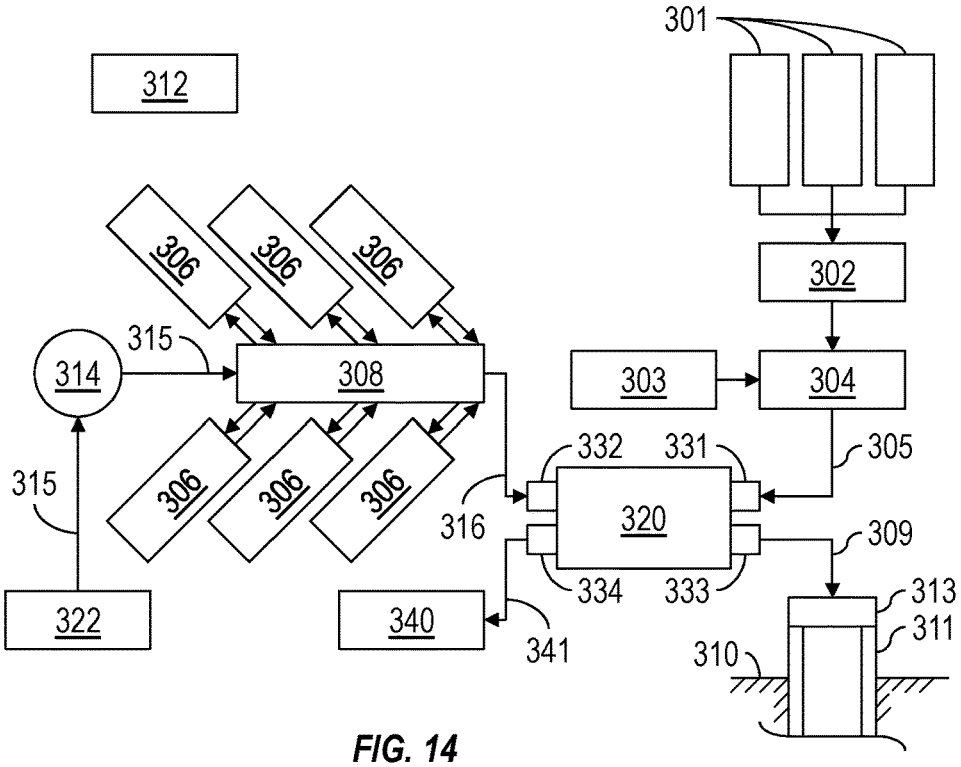
FIG. 14 is a schematic view of at least a portion of an example implementation of apparatus according to one or more aspects of the present disclosure.

FIG. 14 is a schematic view of another example implementation of the system shown in FIG. 13, in which the source of the clean second fluid 120 is the tank 322, and the reduced-pressure fluid discharged from the fluid energizing device 320 is not recycled back into the high-pressure stream, but is instead directed to a tank 340 via a conduit system 341. However, in a similar implementation, the reduced-pressure fluid discharged from the fluid energizing device 320 is not recycled back into the high-pressure stream, as depicted in FIG. 13. In either implementation, utilizing the tank 322 or other source of the clean second fluid separate from the discharge of the gel maker 302 and the fluid energizing device 320 permits a single pass clean fluid system with very low probability of proppant entering the pumps 306.

Figure 15:
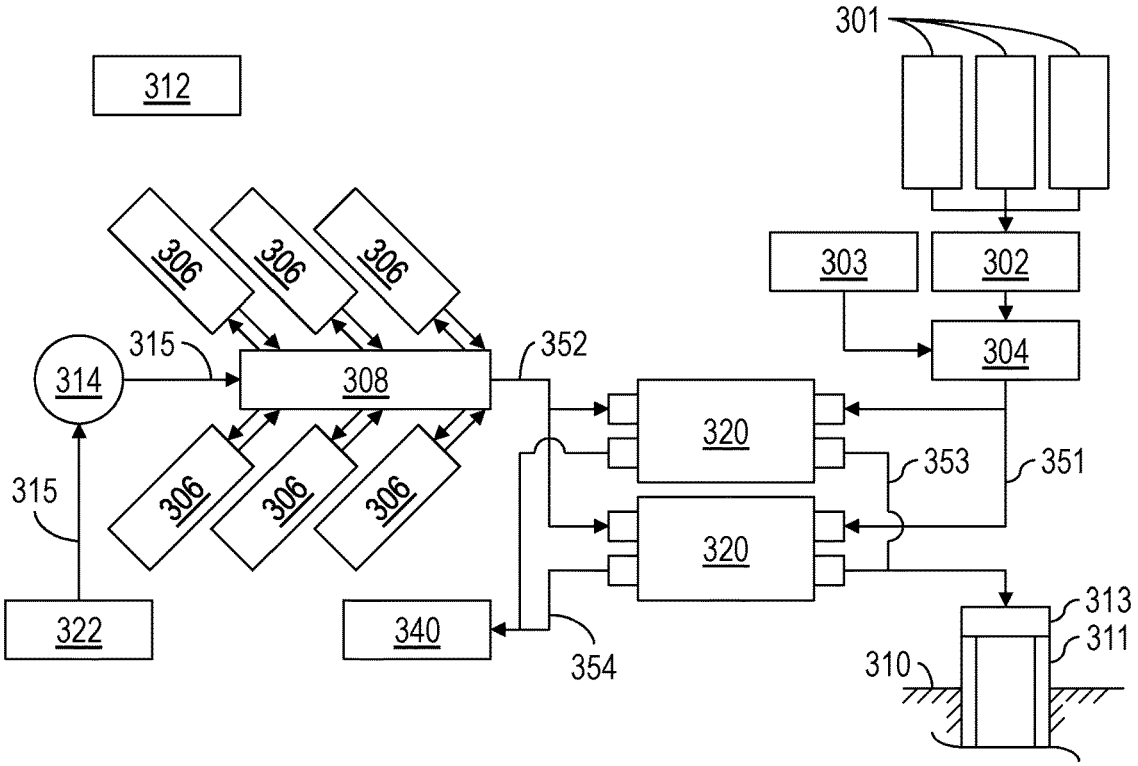
FIG. 15 is a schematic view of at least a portion of an example implementation of apparatus according to one or more aspects of the present disclosure.

FIG. 15 is a schematic view of another example implementation of the system shown in FIG. 14, in which multiple instances of the fluid energizing device 320 are utilized. The low-pressure discharge from the blending apparatus 304 may be split into multiple streams each conducted to a corresponding one of the fluid energizing devices 320 via a conduit system 351. Similarly, the high-pressure discharge from the manifold 308 may be split into multiple streams each conducted to a corresponding one of the fluid energizing devices 320 via a conduit system 352. The energized fluid discharged from the fluid energizing devices 320 may be combined and conducted towards the well 311 via a conduit system 353, and the reduced-pressure discharge from the fluid energizing devices 320 may be combined or separately conducted to the tank 340 via a conduit system 354.

Figure 16:
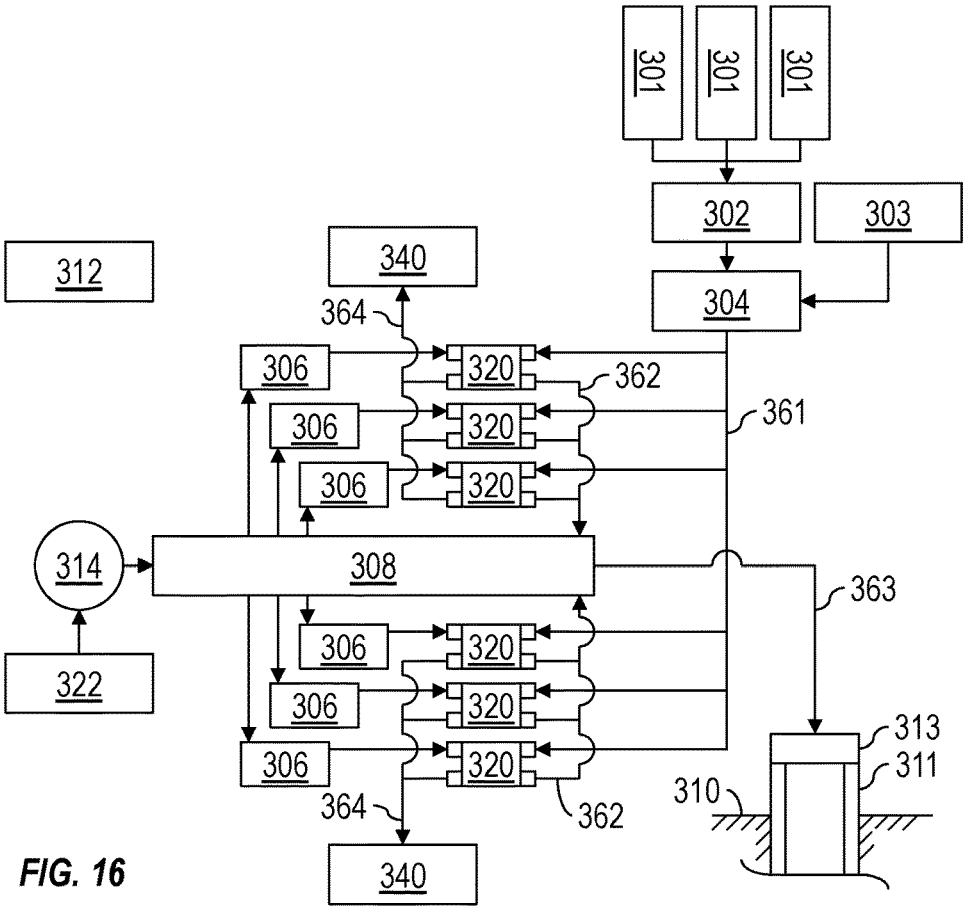
FIG. 16 is a schematic view of at least a portion of an example implementation of apparatus according to one or more aspects of the present disclosure.

FIG. 16 is a schematic view of another example implementation of the system shown in FIG. 14, in which multiple instances of the fluid energizing device 320 are each utilized between the manifold 308 and a corresponding one of the pumps 306. The low-pressure discharge from the blending apparatus 304 may be split into multiple streams each conducted to a corresponding one of the fluid energizing devices 320 via a conduit system 361. The high-pressure discharge from each of the pumps 306 is conducted to a corresponding one of the fluid energizing devices 320 via corresponding conduits (not numbered). The energized fluid discharged from each fluid energizing device 320 is returned to the manifold 308 for combination, via a conduit system 362, and then conducted towards the well 311 via a conduit system 363. The reduced-pressure discharge from the fluid energizing devices 320 may be combined or separately conducted to one or more tanks 340 via a conduit system 364.

Combinations of various aspects of the implementations depicted in FIGS. 12-16 are also within the scope of the present disclosure. For example, the high-pressure side may comprise a dual-stage pumping scheme that pumps a clean fluid from the pumps 306 at a medium pressure and pumps flowback fluid into the clean fluid stream to increase the pressure of the pressurized fluid entering the fluid energizing device 320.

It should be understood that the gel maker 302 and/or other components depicted in the example implementations shown in FIGS. 12-16 may not be included. For example, for low viscosity fluids, the gel maker 302 may not be included. Other components may also be present that are not depicted in the example implementations.

In view of the entirety of the present disclosure, including the figures and the claims, a person having ordinary skill in the art will readily recognize that the present disclosure introduces an apparatus comprising: a first conduit; a second conduit; a fluid energizing device directly or operatively connected between the first and second conduits, wherein the fluid energizing device comprises a chamber, wherein a first fluid enters the chamber from the first conduit, and wherein a second fluid enters the chamber from the second conduit and energizes the first fluid within the chamber; and a third conduit conducting the energized first fluid from the chamber to a wellhead.

The chamber may comprise a first end in connection with the first conduit, a second end in connection with the second conduit, and a membrane defining a first volume and a second volume within the chamber. In such implementations, among others within the scope of the present disclosure, the first fluid may be conducted into the chamber through a first inlet in the first end, the second fluid may be conducted into the chamber through a second inlet in the second end, and the membrane may move within the chamber in response to flow of the first and second fluids into the chamber.

The second fluid may be conducted into the chamber at a higher pressure than the pressure of the first fluid within the chamber such that the higher-pressure second fluid energizes the first fluid within the chamber.

The fluid energizing device may further comprise: a housing containing multiple chambers circumferentially spaced around a perimeter of the housing, wherein the housing is configured for rotary motion around a central axis of the housing; a first end non-rotatably connected to the housing, wherein the first end comprises a first inlet connected to the first conduit and a first outlet connected to the third conduit; and a second end non-rotatably connected to the housing, wherein the second end comprises a second inlet connected to the second conduit and a second outlet connected to a fourth conduit. In such implementations, the first inlet and the second inlet may be wholly or partially misaligned with each other about the central axis such that the first fluid may be conducted from the first conduit to substantially fill one of the chambers before the second fluid is conducted into that chamber from the second conduit, and the first outlet and the second outlet may be wholly or partially misaligned with each other and the first and second inlets about the central axis such that flow of the energized first fluid through the third conduit may be delayed during entry of the first and second fluids into the chamber. The second fluid may be conducted into each chamber at a higher pressure than the pressure of the first fluid within that chamber such that the higher-pressure second fluid energizes the first fluid within that chamber. For example, the first fluid may be conducted into each chamber at a pressure ranging between about 60 psi and about 120 psi, and the second fluid may be conducted into each chamber at a pressure ranging between about 5,000 psi and about 15,000 psi. The second fluid contacts the first fluid within each chamber, and the higher pressure of the second fluid and the contact of the first fluid with the second fluid within each chamber may create a shockwave within that chamber to energize the first fluid within that chamber.

The first fluid may be a drilling fluid, a spacer fluid, a workover fluid, a cement composition, a fracturing fluid, or an acidizing fluid. The first fluid may be a foam, a slurry, an emulsion, or a compressible gas. The first fluid may comprises insoluble particles, may be a high density fluid, or may be a high viscosity fluid, including implementations in which the second fluid may not comprise insoluble particles, may be a low density fluid, or may be a low viscosity fluid. For example, the second fluid may comprise water, a gas, or a combination thereof.

The present disclosure also introduces a method comprising: conducting a first fluid through a first conduit into a chamber of a fluid energizing device; energizing the first fluid within the chamber by conducting a second fluid through a second conduit into the chamber; and conducting the energized first fluid from the chamber to a wellhead.

The chamber may comprise a first end in connection with the first conduit, a second end in connection with the second conduit, and a membrane defining a first volume and a second volume within the chamber. The first fluid may be conducted into the chamber through a first inlet in the first end, the second fluid may be conducted into the chamber through a second inlet in the second end, and the membrane may move within the chamber in response to flow of the first and second fluids into the chamber.

The second fluid may be conducted into the chamber at a higher pressure than the pressure of the first fluid within the chamber such that the higher-pressure second fluid energizes the first fluid within the chamber.

The fluid energizing device may further comprise: a housing containing a plurality of chambers circumferentially spaced around a perimeter of the housing, wherein the housing is configured for rotary motion around a central axis of the housing; a first end non-rotatably connected to the housing, wherein the first end comprises a first inlet connected to the first conduit and a first outlet connected to the third conduit; and a second end non-rotatably connected to the housing, wherein the second end comprises a second inlet connected to the second conduit and a second outlet connected to a fourth conduit. In such implementations, the first inlet and the second inlet may be wholly or partially misaligned with each other about the central axis such that the first fluid may be conducted from the first conduit into one of the chambers to substantially fill that chamber before the second fluid is conducted into that chamber from the second conduit, and the first outlet and the second outlet may be wholly or partially misaligned with each other and the first and second inlets about the central axis such that flow of the energized first fluid from each chamber through the third conduit may be delayed during entry of the first and second fluids into each chamber. The second fluid may be conducted into each chamber at a higher pressure than the pressure of the first fluid within that chamber such that the higher-pressure second fluid energizes the first fluid within that chamber. For example, the first fluid may be conducted into each chamber at a pressure ranging between about 60 psi and about 120 psi, and the second fluid may be conducted into each chamber at a pressure ranging between about 5,000 psi and about 15,000 psi. The second fluid contacts the first fluid within each chamber, and the higher pressure of the second fluid and the contact of the first fluid with the second fluid within each chamber may create a shockwave within that chamber to energize the first fluid within that chamber.

The present disclosure also introduces a method comprising conducting a first fluid into a first one of a plurality of chambers of a fluid energizing device, wherein the fluid energizing device comprises a housing comprising the chambers, a first end cap, and a second end cap. The first end cap may comprise: a first inlet passage in fluid communication with the first one of the chambers; and a first outlet passage not in fluid communication with the first one of the chambers. The second end cap may comprise a second inlet passage and a second outlet passage, neither of which are in fluid communication with the first one of the chambers. The method also comprises energizing the first fluid within the first one of the chambers by: rotating the housing relative to the first and second end caps to establish fluid communication between the second inlet passage and the first one of the chambers while ceasing fluid communication between the first inlet passage and the first one of the chambers; and conducting a second fluid into the first one of the chambers through the second inlet passage. The method also comprises: discharging the energized first fluid from the first one of the chambers by further rotating the housing relative to the first and second end caps to establish fluid communication between the first outlet passage and the first one of the chambers while ceasing fluid communication between the second inlet passage and the first one of the chambers; and conducting the energized first fluid discharged from the first one of the chambers into a well.

Conducting the second fluid into the first one of the chambers may create a shockwave within the first one of the chambers, thereby energizing the first fluid within the first one of the chambers.

Rotating the housing relative to the first and second end caps to establish fluid communication between the second inlet passage and the first one of the chambers while ceasing fluid communication between the first inlet passage and the first one of the chambers may also establish fluid communication between the first inlet passage and a second one of the chambers. In such implementations, the method further comprises: conducting the first fluid into the second one of the chambers while conducting the second fluid into the first one of the chambers; energizing the first fluid within the second one of the chambers by rotating the housing relative to the first and second end caps to establish fluid communication between the second inlet passage and the second one of the chambers while ceasing fluid communication between the first inlet passage and the second one of the chambers, and conducting the second fluid into the second one of the chambers through the second inlet passage; discharging the energized first fluid from the second one of the chambers by further rotating the housing relative to the first and second end caps to establish fluid communication between the first outlet passage and the second one of the chambers while ceasing fluid communication between the second inlet passage and the second one of the chambers; and conducting the energized first fluid discharged from the second one of the chambers into the well.

The method may further comprise discharging the reduced-pressure second fluid remaining in the first one of the chambers by further rotating the housing relative to the first and second end caps to establish fluid communication between the second outlet passage and the first one of the chambers while ceasing fluid communication between the first outlet passage and the first one of the chambers.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to permit the reader to quickly ascertain the nature of the technical disclosure. It is submitted with the understanding that it will not be used to interpret or limit the scope or meaning of the claims.

What is claimed is:

1. An apparatus comprising:

a gel maker;

a blending apparatus operatively coupled with the gel maker;

a first conduit in fluid communication with the blending apparatus;

a manifold;

a plurality of pumps operatively coupled with the manifold;

a second conduit in fluid communication with the manifold;

a fluid energizing device directly or operatively connected between the first and second conduits, wherein the fluid energizing device comprises a chamber, wherein a first fluid enters the chamber from the first conduit, and wherein a second fluid enters the chamber from the second conduit and energizes the first fluid within the chamber upon operation of the plurality of pumps which pump fluid under pressure through the manifold; and a third conduit conducting the energized first fluid from the chamber to a wellhead, wherein the chamber comprises a first end in connection with the first conduit, a second end in connection with the second conduit, and a semi-permeable membrane defining a first volume and a second volume within the chamber.

2. The apparatus of claim 1 wherein the first fluid is conducted into the chamber through a first inlet in the first end, the second fluid is conducted into the chamber through a second inlet in the second end, and the membrane moves within the chamber in response to flow of the first and second fluids into the chamber.

3. The apparatus of claim 1 wherein the second fluid is conducted into the chamber at a higher pressure than the pressure of the first fluid within the chamber such that the higher-pressure second fluid energizes the first fluid within the chamber.

4. The apparatus of claim 1 wherein the fluid energizing device further comprises:

a housing containing multiple chambers circumferentially spaced around a perimeter of the housing, wherein the housing is configured for rotary motion around a central axis of the housing;

a first end cap non-rotatably connected to the housing, wherein the first end comprises a first inlet connected to the first conduit and a first outlet connected to the third conduit; and a second end cap non-rotatably connected to the housing, wherein the second end comprises a second inlet connected to the second conduit and a second outlet connected to a fourth conduit.

5. The apparatus of claim 4 wherein:

the first inlet and the second inlet are wholly or partially misaligned with each other about the central axis such that the first fluid is conducted from the first conduit to substantially fill one of the chambers before the second fluid is conducted into that chamber from the second conduit; and the first outlet and the second outlet are wholly or partially misaligned with each other and the first and second inlets about the central axis such that flow of the energized first fluid through the third conduit is delayed during entry of the first and second fluids into each chamber.

6. The apparatus of claim 5 wherein the second fluid is conducted into each chamber at a higher pressure than the pressure of the first fluid within that chamber such that the higher-pressure second fluid energizes the first fluid within that chamber.

7. The apparatus of claim 6 wherein the first fluid is conducted into each chamber at a pressure ranging between about 60 pounds force per square inch (psi) and about 120 psi, and wherein the second fluid is conducted into each chamber at a pressure ranging between about 5,000 psi and about 15,000 psi.

8. The apparatus of claim 1 wherein the first fluid is a drilling fluid, a spacer fluid, a workover fluid, a cement composition, a fracturing fluid, or an acidizing fluid.

9. The apparatus of claim 8 wherein the first fluid is a foam, a slurry, an emulsion, or a compressible gas.

10. The apparatus of claim 9 wherein the first fluid comprises insoluble particles, is a high density fluid, or is a high viscosity fluid, and wherein the second fluid does not comprise insoluble particles, is a low density fluid, or is a low viscosity fluid.

11. The apparatus of claim 10 wherein the second fluid comprises water, a gas, or a combination thereof.

12. A method comprising:

mixing water and proppant in a blending apparatus to form a first fluid;

conducting the first fluid through a first conduit into a chamber of a fluid energizing device;

energizing the first fluid within the chamber by moving a second fluid into the chamber in a manner which creates a shockwave by using an input pressure of the second fluid which is sufficiently greater than an input pressure of the first fluid; and conducting the energized first fluid from the chamber to a wellhead.

13. The method of claim 12 wherein the fluid energizing device further comprises:

a housing containing a plurality of chambers circumferentially spaced around a perimeter of the housing, wherein the housing is configured for rotary motion around a central axis of the housing;

a first end cap non-rotatably connected to the housing, wherein the first end comprises a first inlet connected to the first conduit and a first outlet connected to the third conduit; and a second end cap non-rotatably connected to the housing, wherein the second end comprises a second inlet connected to the second conduit and a second outlet connected to a fourth conduit.

14. The method of claim 13 wherein:

the first inlet and the second inlet are wholly or partially misaligned with each other about the central axis such that the first fluid is conducted from the first conduit into one of the chambers to substantially fill that chamber before the second fluid is conducted into that chamber from the second conduit; and the first outlet and the second outlet are wholly or partially misaligned with each other and the first and second inlets about the central axis such that flow of the energized first fluid from each chamber through the third conduit is delayed during entry of the first and second fluids into each chamber.

15. A method comprising:

conducting a first fluid from a well treatment fluid mixing tank and into a first one of a plurality of chambers of a fluid energizing device, wherein the fluid energizing device comprises:

a housing comprising the chambers;

a first end cap comprising:

a first inlet passage in fluid communication with the first one of the chambers; and a first outlet passage not in fluid communication with the first one of the chambers; and a second end cap comprising a second inlet passage and a second outlet passage, neither of which are in fluid communication with the first one of the chambers;

energizing the first fluid within the first one of the chambers by:

rotating the housing relative to the first and second end caps to establish fluid communication between the second inlet passage and the first one of the chambers while ceasing fluid communication between the first inlet passage and the first one of the chambers; and conducting a second fluid into the first one of the chambers through the second inlet passage by employing a plurality of cooperating high pressure pumps at a wellsite, wherein conducting the second fluid into the first one of the chambers creates a shockwave within the first one of the chambers, thereby energizing the first fluid within the first one of the chambers;

discharging the energized first fluid from the first one of the chambers by further rotating the housing relative to the first and second end caps to establish fluid communication between the first outlet passage and the first one of the chambers while ceasing fluid communication between the second inlet passage and the first one of the chambers;

conducting the energized first fluid discharged from the first one of the chambers into a well; and arranging the first and second inlet passages and the first and second outlet passages to permit fluid flow into and out of more than one chamber, of the plurality of chambers, at a time.

16. The method of claim 15 wherein rotating the housing relative to the first and second end caps to establish fluid communication between the second inlet passage and the first one of the chambers while ceasing fluid communication between the first inlet passage and the first one of the chambers also establishes fluid communication between the first inlet passage and a second one of the chambers, and wherein the method further comprises:

conducting the first fluid into the second one of the chambers while conducting the second fluid into the first one of the chambers;

energizing the first fluid within the second one of the chambers by:

rotating the housing relative to the first and second end caps to establish fluid communication between the second inlet passage and the second one of the chambers while ceasing fluid communication between the first inlet passage and the second one of the chambers; and conducting the second fluid into the second one of the chambers through the second inlet passage;

discharging the energized first fluid from the second one of the chambers by further rotating the housing relative to the first and second end caps to establish fluid communication between the first outlet passage and the second one of the chambers while ceasing fluid communication between the second inlet passage and the second one of the chambers; and conducting the energized first fluid discharged from the second one of the chambers into the well.

17. The method of claim 15 further comprising discharging the reduced-pressure second fluid remaining in the first one of the chambers by further rotating the housing relative to the first and second end caps to establish fluid communication between the second outlet passage and the first one of the chambers while ceasing fluid communication between the first outlet passage and the first one of the chambers.

* * * * *